US006822153B2

(12) United States Patent
Comair et al.

(10) Patent No.: US 6,822,153 B2
(45) Date of Patent: Nov. 23, 2004

(54) METHOD AND APPARATUS FOR INTERACTIVE REAL TIME MUSIC COMPOSITION

(75) Inventors: Claude Comair, Vancouver (CA); Rory Johnston, Bellevue, WA (US); Lawrence Schwedler, Sammamish, WA (US); James Phillipsen, Seattle, WA (US)

(73) Assignee: Nintendo Co., Ltd., Kyoto (JP)

( * ) Notice: Subject to any disclaimer, the term of this patent is extended or adjusted under 35 U.S.C. 154(b) by 0 days.

(21) Appl. No.: 10/143,812

(22) Filed: May 14, 2002

(65) Prior Publication Data

US 2003/0037664 A1 Feb. 27, 2003

Related U.S. Application Data

(60) Provisional application No. 60/290,689, filed on May 15, 2001.

(51) Int. Cl.[7] ..... G10H 7/00; G04B 13/00; A63H 5/00

(52) U.S. Cl. ..... 84/609; 84/645

(58) Field of Search ..... 84/609, 610, 614, 84/634, 645

(56) References Cited

U.S. PATENT DOCUMENTS 4,348,929 A 9/1982 Gallitzendörfer
5,146,833 A 9/1992 Lui (List continued on next page.)

OTHER PUBLICATIONS

Sonic Foundry, ACID 2.0 Manual, 1999.*
Web site information, www.harmonixmusic.com, "The Axe" CD.
"Introducing The Axe," instruction booklet.
Pham, Alex, "Music Takes on a Hollywood Edge, Game Design," *Los Angeles Times*, Dec. 27, 2001.

*Primary Examiner*—Jeffrey W Donels
(74) *Attorney, Agent, or Firm*—Nixon & Vanderhye P.C.

(57) ABSTRACT

An interactive dynamic musical composition real time music presentation video game system uses individually composed musical compositions stored as building blocks. The building blocks are structured as nodes of a sequential state machine. Transitions between states are defined based on exit point of current state and entrance point into the new state. Game-related parameters can trigger transition from one compositional building block to another. For example, an interactivity variable can keep track of the current state of the video game or some aspect of it. In one example, an adrenaline counter gauging excitement based on the number of game objectives that have been accomplished can be used to control transitions between more relaxed musical states to more exciting and energetic musical states. Transitions can be handled by cross-fading between one music compositional component to another, or by providing transitional compositions. The system can be used to dynamically generate a musical composition in real time. Advantages include allowing a musical composer to compose a number of discrete musical compositions corresponding to different video game or other multimedia presentation states, and providing smooth transition between the different compositions responsive to interactive user input and/or other parameters.

20 Claims, 18 Drawing Sheets

U.S. PATENT DOCUMENTS 5,315,057 A 5/1994 Land et al.
5,331,111 A * 7/1994 O'Connell ..... 84/602
5,451,709 A 9/1995 Minamitaka
5,627,335 A 5/1997 Rigopulos et al.
5,663,517 A 9/1997 Oppenheim
5,679,913 A * 10/1997 Bruti et al. ..... 84/609
5,753,843 A 5/1998 Fay
5,763,800 A 6/1998 Rossum et al.
5,763,804 A 6/1998 Rigopulos et al.
5,945,986 A 8/1999 Bargar et al.
6,011,212 A 1/2000 Rigopulos et al.
6,084,168 A 7/2000 Sitrick
6,093,880 A * 7/2000 Arnalds ..... 84/464 R
6,096,962 A 8/2000 Crowley
6,169,242 B1 * 1/2001 Fay et al. ..... 84/609
6,485,369 B2 11/2002 Kondo et al.
6,528,715 B1 * 3/2003 Gargi ..... 84/615
6,658,309 B1 * 12/2003 Abrams et al. ..... 700/94

* cited by examiner

METHOD AND APPARATUS FOR INTERACTIVE REAL TIME MUSIC COMPOSITION

CROSS-REFERENCES TO RELATED APPLICATIONS

This application claims the benefit of U.S. Provisional Application No. 60/290,689 filed May 15, 2001, which is incorporated herein by reference.

STATEMENT REGARDING FEDERALLY SPONSORED RESEARCH OR DEVELOPMENT

Not Applicable

FIELD OF THE INVENTION

The invention relates to computer generation of music and sound effects, and more particularly, to video game or other multimedia applications which interactively generate a musical composition or other audio in response to game state. Still more particularly, the invention relates to systems and methods for generating, in real time, a natural-sounding musical score or other sound track by handling smooth transitions between disparate pieces of music or other sounds.

BACKGROUND AND SUMMARY OF THE INVENTION

Music is an important part of the modern entertainment experience. Anyone who has ever attended a live sports event or watched a movie in the theater or on television knows that music can significantly add to the overall entertainment value of any presentation. Music can, for example, create excitement, suspense, and other mood shifts. Since teenagers and others often accompany many of their everyday experiences with a continual music soundtrack through use of mobile and portable sound systems, the sound track accompanying a movie, video game or other multimedia presentation can be a very important factor in the success, desirability or entertainment value of the presentation.

Back in the days of early arcade video games, players were content to hear occasional sound effects emanating from arcade games. As technology has advanced and state-of-the-art audio processing capabilities have been incorporated into relatively inexpensive home video game platforms, it has become possible to accompany exciting three-dimensional graphics with interesting and exciting high quality music and sound effects. Most successful video games have both compelling, exciting graphics and interesting musical accompaniment.

One way to provide an interesting sound track for a video game or other multimedia application is to carefully compose musical compositions to accompany each different scene in the game. In an adventure type game, for example, every time a character enters a certain room or encounters a certain enemy, the game designer can cause an appropriate theme music or leitmotiv to begin playing. Many successful video games have been designed based on this approach. An advantage is that the game designer has a high degree of control over exactly what music is played under what game circumstances—just as a movie director controls which music is played during which parts of the movie. The result can be a very satisfying entertainment experience. Sometimes, however, there can be a lack of spontaneity and adaptability to changing video game interactions. By planning and predetermining each and every complete musical composition and transition in advance, the music sound track of a video game or interactive multimedia presentation can sometime sound the same each time the movie or video game is played without taking into account changes in game play due to user interactivity. This can be monotonous to frequent players.

In a sports or driving game, it may be desirable to have the type and intensity of the music reflect the level of competition and performance of the corresponding game play. Many games play the same music irrespective of the game player's level of performance and other interactivity-based factors. Imagine the additional excitement that could be created in a sports or driving game if the music becomes more intense or exciting as the game player competes more effectively and performs better.

People in the past have programmed computers to compose music or sounds in real time. However, such attempts at dynamic musical composition by computer have generally not been particularly successful since the resulting music can sound very machine-like. No one has yet developed a computerized music compositional engine capable of matching, in terms of creativity, interest and fun factor, the music that a talented human composer can compose. Thus, there is a long-felt but unsolved need for an interactive dynamic musical composition engine for use in video games, multimedia and other applications that allows a human musical composer to define, specify and control the basic musical material to be presented while also allowing a real time parameter (e.g., related to user interactivity) to dynamically "compose" the music being played.

The present invention solves this problem by providing a system and method that dynamically generates sounds (e.g., music, sound effects, and/or other sounds) based on a combination of predefined compositional building blocks and a real time interactivity parameter, by providing a smooth transition between precomposed segments. In accordance with one aspect provided by an illustrative exemplary embodiment of the present invention, a human composer composes a plurality of musical compositions and stores them in corresponding sound files. These sound files are assigned states of a sequential state machine. Connections between states are defined specifying transitions between the states—both in terms of sound file exit/entrance points and in terms of conditions for transitioning between the states. This illustrative arrangement provides for both variations provided through interactivity and also the complexity and appropriateness of predefined composition.

The preferred illustrative embodiment music presentation system can dynamically "compose" a musical or other audio presentation based on user activity by dynamically selecting between different, precomposed music and/or sound building blocks. Different game players (or the same game player playing the game at different times) will experience different dynamically-generated overall musical compositions—but with the musical compositions based on musical composition building blocks thoughtfully precomposed by a human musical composer in advance.

As one example, a transition from more serene precomposed musical segment to more intense or exciting precomposed musical segment can be triggered by a certain predetermined interactivity state (e.g., success or progress in a competition-type game, as gauged for example by an "adrenaline meter"). A further transition to even more exciting or energetic precomposed musical segment can be triggered by further success or performance criteria based upon additional interaction between the user and the application. If the user suffers a setback or otherwise fails to maintain the attained level of energy in the graphics portion of the game play or other multimedia application, a further transition to lower-energy precomposed musical segments can occur.

In accordance with yet another aspect provided by the invention, a game play parameter can be used to randomly or pseudo-randomly select a set of musical composition building blocks the system will use to dynamically create a musical composition. For example, a pseudo-random number generator (e.g., based on detailed hand-held controller input timing and/or other variable input) can be used to set a game play environment state value. This game play environment state value may be used to affect the overall state of the game play environment—including the music and other sound effects that are presented. As one example, the game play environment state value can be used to select different weather conditions (e.g., sunny, foggy, stormy), different lighting conditions (e.g., morning, afternoon, evening, nighttime), different locations within a three-dimensional world (e.g., beach, mountaintop, woods, etc.) or other environmental condition(s). The graphics generator produces and displays graphics corresponding to the environment state parameter, and the audio presentation engine may select a corresponding musical theme (e.g., mysterious music for a foggy environment, ominous music for a stormy environment, joyous music for a sunny environment, contemplative music for a nighttime environment, surfer music for a beach environment, etc.).

In the preferred embodiment, a game play environment parameter value is used to select a particular set or "cluster" of musical states and associated composition components. Game play interactivity parameters may then be used to dynamically select and control transitions between states within the selected cluster.

In accordance with yet another aspect provided by the invention, a transition between one musical state and another may be provided in a number of ways. For example, the musical building blocks corresponding to states may comprise looping-type audio data structures designed to play continually. Such looping-type data structures (e.g., sound files) may be specified to have a number of different entrance and exit points. When a transition is to occur from one musical state to another, the transition can be scheduled to occur at the next-encountered exit point of the current musical state for transitioning into a corresponding entrance point of a further musical state. Such transitions can be provided via cross-fading to avoid an abrupt change. Alternatively, if desired, transitions can be made via intermediate, transitional states and associated musical "bridging" material to provide smooth and aurally pleasing transitions.

BRIEF DESCRIPTION OF THE DRAWINGS

These and other features and advantages may be better and more completely understood by referring to the following detailed description of presently preferred embodiments in conjunction with the drawings of which.

DETAILED DESCRIPTION OF PRESENTLY PREFERRED EXAMPLE EMBODIMENTS

A typical computer-based player of a recorded piece of music or other sound will, when switching songs, generally do it immediately. The preferred exemplary embodiment, on the other hand, allows the generation of a musical score or other sound track that flows naturally between various distinct pieces of music or other sounds.

In the exemplary embodiment, exit points are placed by the composer or musician in a separate database related to the song or other sound segment. An exit point is a relative point in time from the start of a song or sound segment. This is usually in ticks for MIDI files or seconds for other files (e.g., WAV, MP3, etc.).

In the example embodiment, any song or other sound segment can be connected to any other song or sound segment to create a transition consisting of a start song and end song. Each exit point in the start song can have a corresponding entry point in the end song. In this example, an entry point is a relative point in time from the start of a song. Paired with an exit point in the source song of a connection, the entry point tells at what position to start playing the destination song from. It also stores necessary state information within it to allow starting in the middle of a song.

Figure 1A:
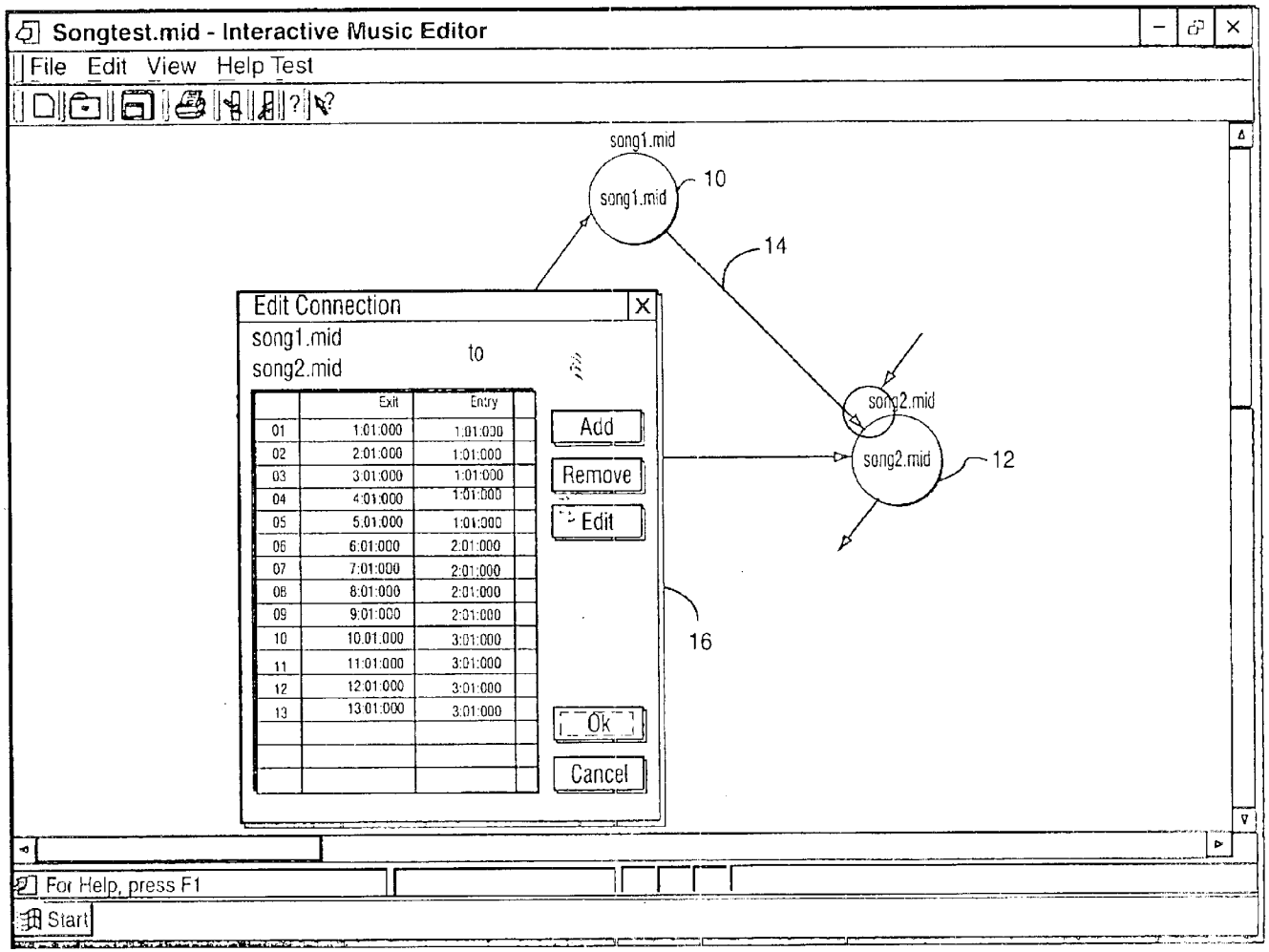
FIGS. 1A–1B and 2A–2C illustrate exemplary connections between songs or other musical or sound segments.

As illustrated in FIG. 1A, a connection from song 1 to song 2 does not necessarily imply a direction from song 1 to song 2. Connections can be unidirectional in either direction, or they can be bi-directional. More than one exit point in a start song may point to the same entry point in an end song, but each exit point is unique in the exemplary embodiment. When two songs are connected, it is possible to specify that the transition happen immediately—cutting off the previous song at the instant of the song change request and starting the new song. Each connection between an exit and entry point may also optionally specify a transition song that plays once before starting the new song. See FIG. 1B for example.

Figure 1B:
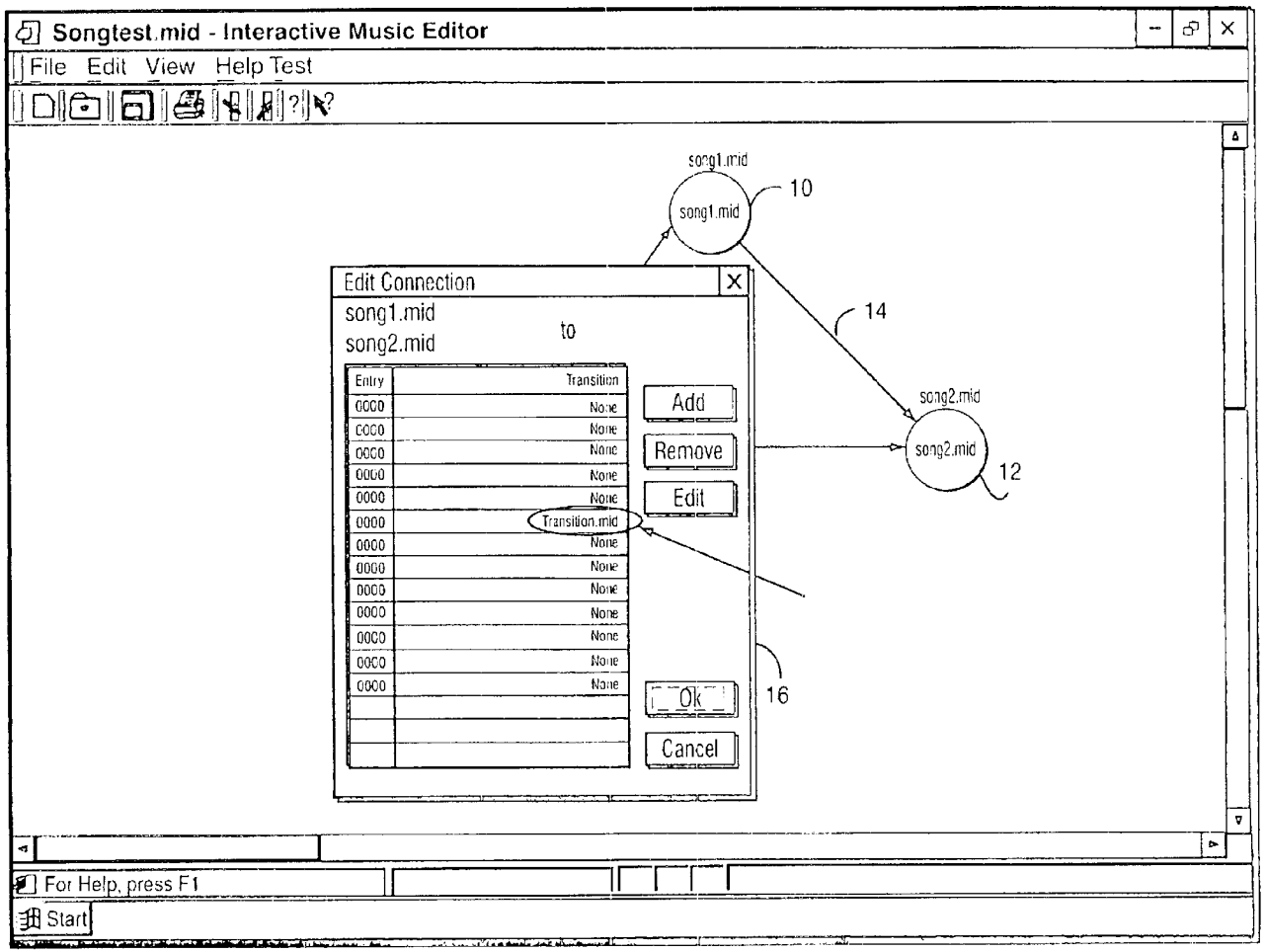
Figure 1C:
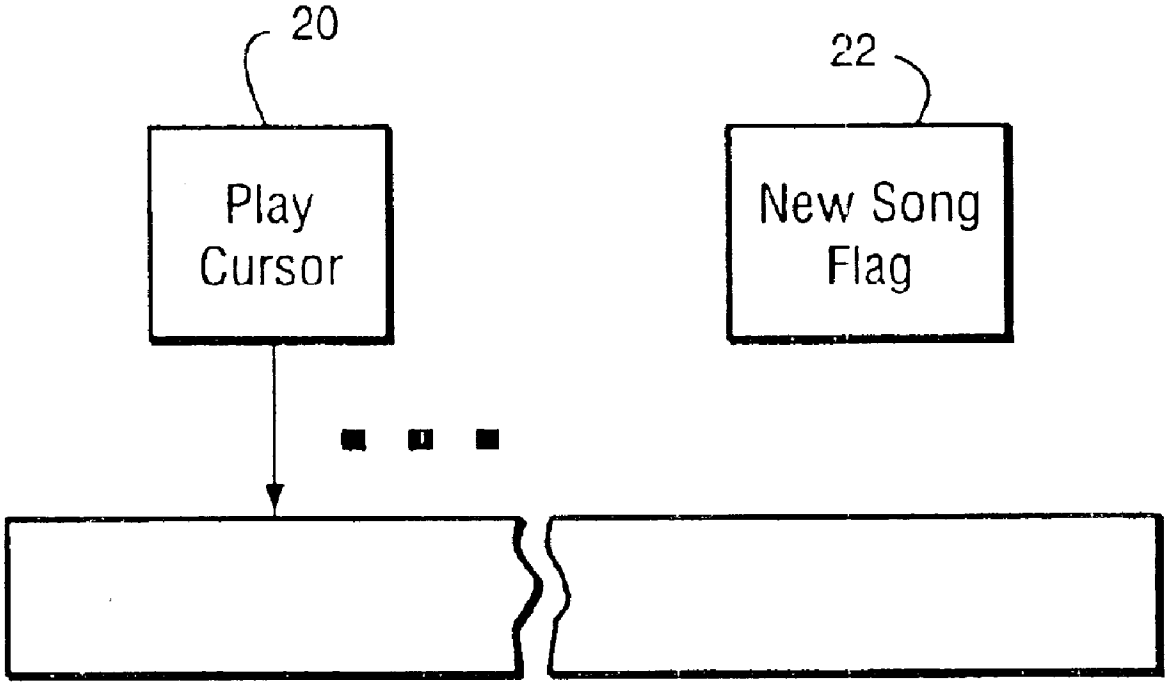
FIG. 1C shows example data structures.

When a song is being played back in the illustrative embodiment, it has a play cursor 20 keeping track of the current position within the total length or the song and a "new song" flag 22 telling if a new song is queued (see FIG. 1C). When a request to play a new song is received, the interactive music program determines which exit point is closest to the play cursor 20's current position and tells the hardware or software player to queue the new song at the corresponding entry point. When the hardware or software player reaches an exit point in the current song and a new song has been queued, it stops the current song and starts playing the new song from the corresponding entry point. If a request for another song is received while a song is already in the queue, a transition to the most recently requested song replaces the transition to the previously queued song. In the exemplary embodiment, if another song is queued after that, it replaces the last one in the queue, thus keeping too many songs from queuing up—which is useful when times between exit points are long.

In more detail, FIG. 1A shows a "song 1" sound segment 10, a "song 2" sound segment 12, and a transition 14 between segment 10 and segment 12. An additional "connection" display screen 16 shows, for purposes of this illustrative embodiment, that transition 14 may comprise a number (in this case 13) possible transitions between "song 1" segment 10 and "song 2" segment 12. For example, in this illustration, thirteen different potential exit points are predefined with the "song 1" segment 10. The first exit point is defined at the beginning of the associated "song 1" segment (i.e., at 1:01:000). Note that in the exemplary embodiment, the "song 1" segment 10 may be a "looping" file so that the "beginning" of the segment is joined to the end of the segment to create a continuous-play sound segment that continually loops over and over again until it is exited. As screen 16 shows, an exit from this predetermined exit point will cause transition 14 to enter the "song 2" at a predetermined entry point which is also at the beginning of the "song 2" segment. As shown in the illustration, additional exit points within the "song 1" sound segment also cause transition into the beginning (1:01:000) of the "song 2" sound segment. In the illustration shown, additional exit points from the "song 1" segment cause transitions to different entry points within the "song 2" segment 12. For example, in the illustration, exit points defined at "6:01:000, 7:01:000, 8:01:000 and 9:01:000" of the "song 1" segment cause a transition to an entry point 2:01:000 within the "song 2" segment 12. Similarly, exit points defined at 10:01:000, 11:01:000, 12:01:000 and 13:01:000 of the "song 1" segment 10 cause a transition to a still different predefined entry point 3:01:000 of the "song 2" segment.

FIG. 1B shows that when the "connection" screen is scrolled over to the right in the exemplary embodiment, there is revealed a "transition" indicator that allows the composer to specify an optional transition sound segment. Such a transition sound segment can be, for example, bridging or segueing material to provide an even smoother transition between two different sound segments. If a transition segment is specified, then the associated transitional material is played after exiting from the current sound segment and before entering the next sound segment at the corresponding predefined entry and exit points. As will be understood, in other embodiments it may be desirable to have entry and exit points default or otherwise occur at the beginnings of sound files and to provide transitions between sound files as otherwise described herein.

Figure 2A:
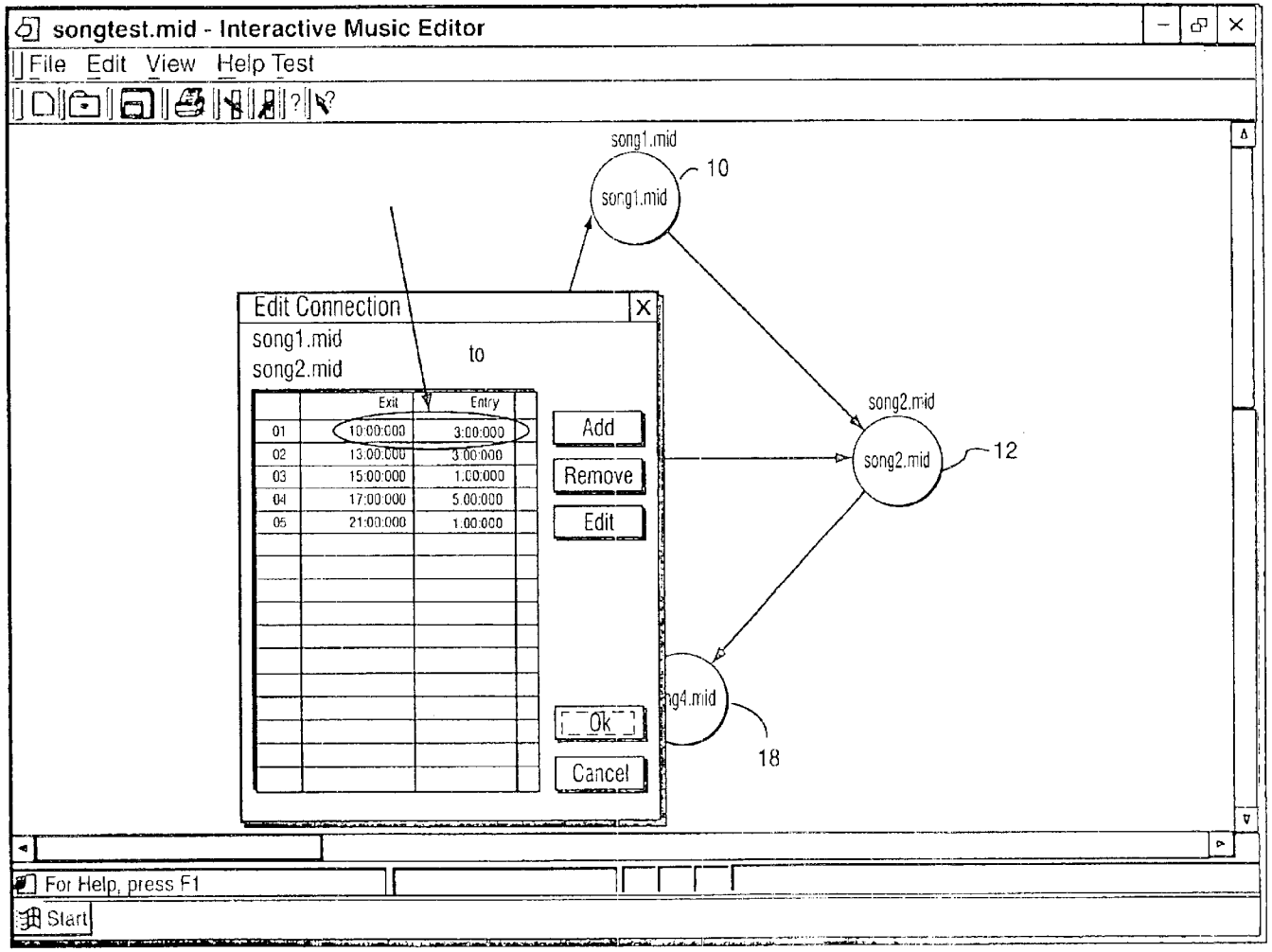
Figure 2B:
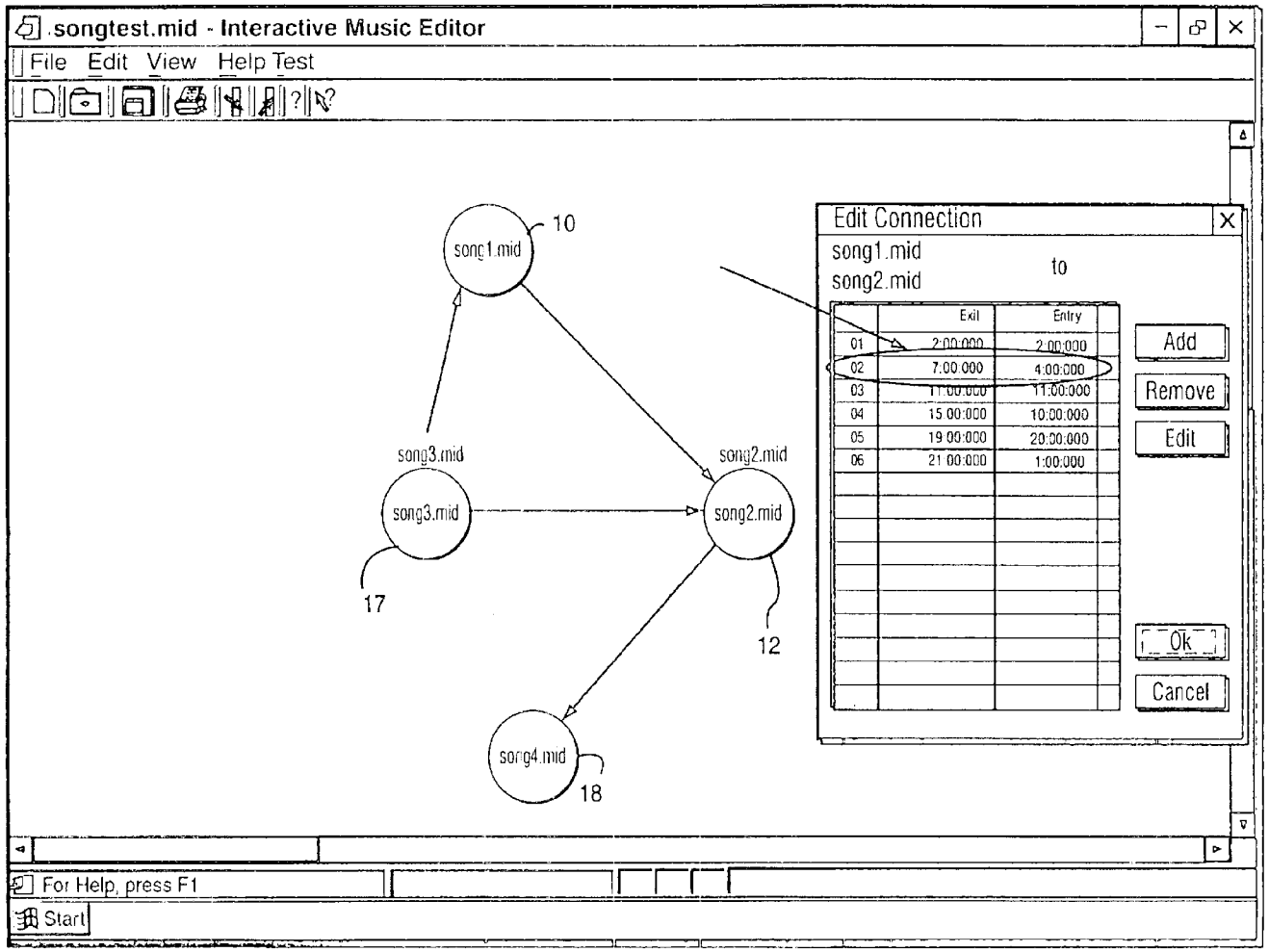
Figure 2C:
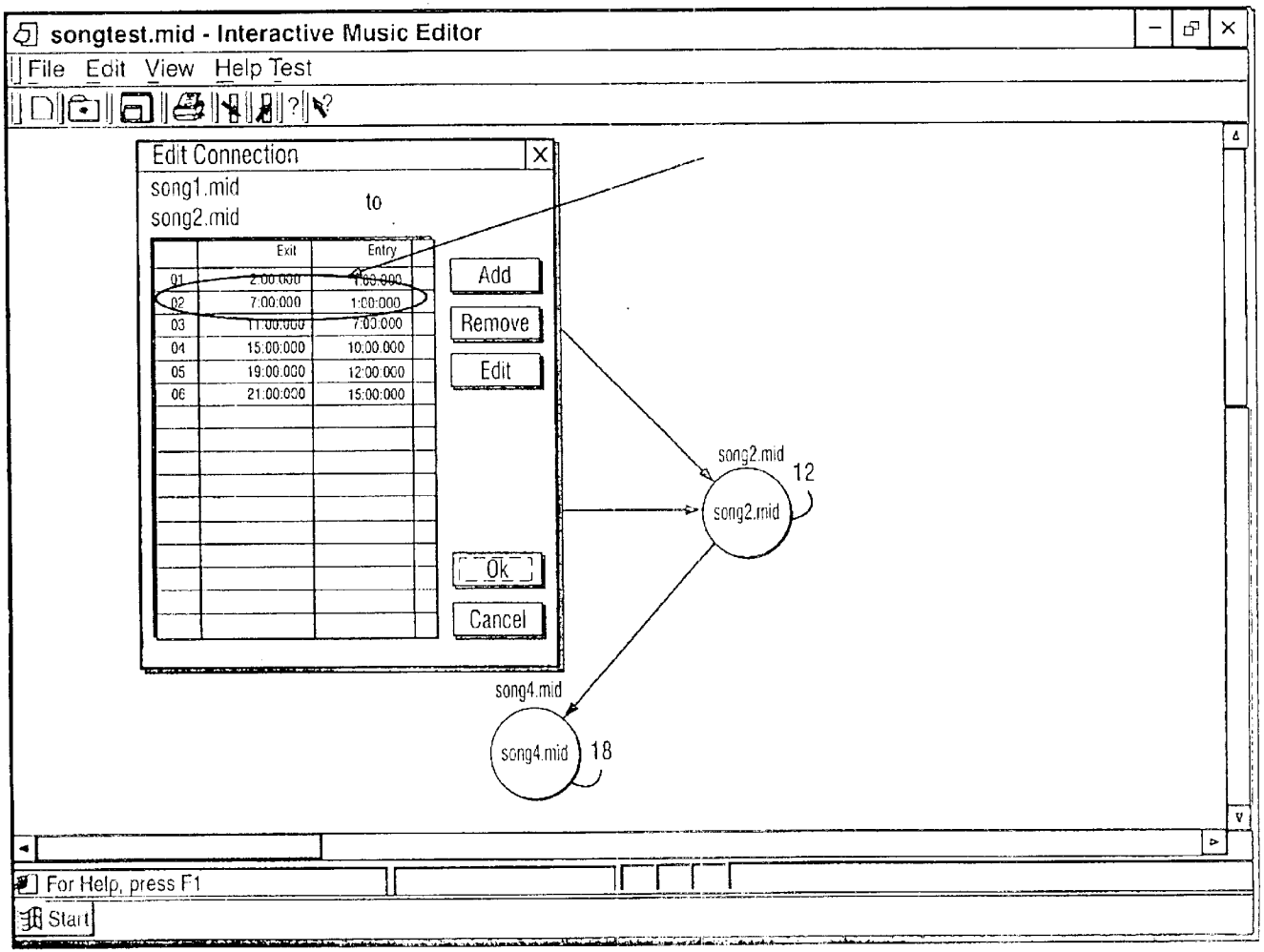

FIGS. 2A–2C provide a further, more complex illustration showing a sound system or cluster involving four different sound segments and numerous possible transitions therebetween. For example, in FIG. 2A, we see exemplary connections between songs 1 and 2; in FIG. 2B, we see exemplary connections between songs 2 and 3; and in FIG. 2C we see exemplary connections between songs 2 and 4. In the example shown, if song 1 is playing with the play cursor 20 at 5 seconds, and a request has been made to switch to song 2, song 2 is queued up. When song 1's play cursor 20 hits its first exit point at 10 seconds, it will switch to song 2, at the entry point 3 seconds from the start of song 2. Now, if immediately following that, a request to switch to song 3 is made, then when the transition from song 1 to song 2 is completed, song 3 will be queued to start when song 2 has hit its next exit point, in this case at 7 seconds. But, if before song 1 has switched to song 3, a request is received to switch to song 4, song 3 is removed from the queue so when song 2 hits its next exit point (7 seconds), song 4 will start at its entry point at 1 second.

Example More Detailed Implementation

Figure 3A:
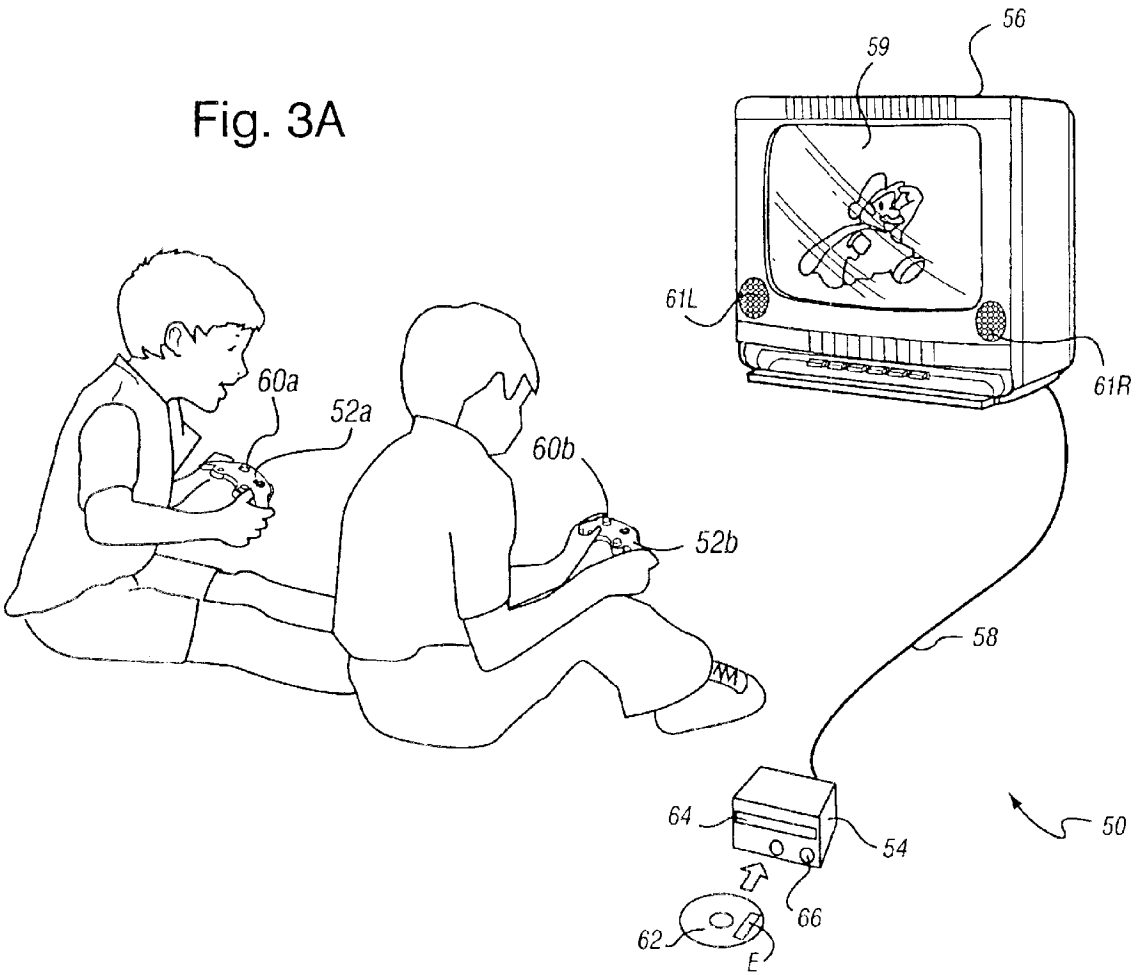
FIGS. 3A–3C show an example overall video game or other interactive multimedia presentation system that may embody the present invention.

FIG. 3A shows an example interactive 3D computer graphics system 50 that can be used to play interactive 3D video games with interesting stereo sound composed by a preferred embodiment of this invention. System 50 can also be used for a variety of other applications.

In this example, system 50 is capable of processing, interactively in real time, a digital representation or model of a three-dimensional world. System 50 can display some or all of the world from any arbitrary viewpoint. For example, system 50 can interactively change the viewpoint in response to real time inputs from handheld controllers 52*a*, 52*b* or other input devices. This allows the game player to see the world through the eyes of someone within or outside of the world. System 50 can be used for applications that do not require real time 3D interactive display (e.g., 2D display generation and/or non-interactive display), but the capability of displaying quality 3D images very quickly can be used to create very realistic and exciting game play or other graphical interactions.

To play a video game or other application using system 50, the user first connects a main unit 54 to his or her color television set 56 or other display device by connecting a cable 58 between the two. Main unit 54 produces both video signals and audio signals for controlling color television set 56. The video signals are what controls the images displayed on the television screen 59, and the audio signals are played back as sound through television stereo loudspeakers 61L, 61R.

The user also needs to connect main unit 54 to a power source. This power source may be a conventional AC adapter (not shown) that plugs into a standard home electrical wall socket and converts the house current into a lower DC voltage signal suitable for powering the main unit 54. Batteries could be used in other implementations.

The user may use hand controllers 52*a*, 52*b* to control main unit 54. Controls 60 can be used, for example, to specify the direction (up or down, left or right, closer or further away) that a character displayed on television 56 should move within a 3D world. Controls 60 also provide input for other applications (e.g., menu selection, pointer/cursor control, etc.). Controllers 52 can take a variety of forms. In this example, controllers 52 shown each include controls 60 such as joysticks, push buttons and/or directional switches. Controllers 52 may be connected to main unit 54 by cables or wirelessly via electromagnetic (e.g., radio or infrared) waves.

To play an application such as a game, the user selects an appropriate storage medium 62 storing the video game or other application he or she wants to play, and inserts that storage medium into a slot 64 in main unit 54. Storage medium 62 may, for example, be a specially encoded and/or encrypted optical and/or magnetic disk. The user may operate a power switch 66 to turn on main unit 54 and cause the main unit to begin running the video game or other application based on the software stored in the storage medium 62. The user may operate controllers 52 to provide inputs to main unit 54. For example, operating a control 60 may cause the game or other application to start. Moving other controls 60 can cause animated characters to move in different directions or change the user's point of view in a 3D world. Depending upon the particular software stored within the storage medium 62, the various controls 60 on the controller 52 can perform different functions at different times.

As also shown in FIG. 3A, mass storage device 62 stores, among other things, a music composition engine E used to dynamical compose music. The details of preferred embodiment music composition engine E will be described shortly. Such music composition engine E in the preferred embodiment makes use of various components of system 50 shown in FIG. 3B including:

a main processor (CPU) 110, a main memory 112, and a graphics and audio processor 114.

In this example, main processor 110 (e.g., an enhanced IBM Power PC 750) receives inputs from handheld controllers 52 (and/or other input devices) via graphics and audio processor 114. Main processor 110 interactively responds to user inputs, and executes a video game or other program supplied, for example, by external storage media 62 via a mass storage access device 106 such as an optical disk drive. As one example, in the context of video game play, main processor 110 can perform collision detection and animation processing in addition to a variety of interactive and control functions.

In this example, main processor 110 generates 3D graphics and audio commands and sends them to graphics and audio processor 114. The graphics and audio processor 114 processes these commands to generate interesting visual images on display 59 and interesting stereo sound on stereo loudspeakers 61R, 61L or other suitable sound-generating devices. Main processor 110 and graphics and audio processor 114 also perform functions to support and implement preferred embodiment music composition engine E based on instructions and data E' relating to the engine that is stored in DRAM main memory 112 and mass storage device 62.

Figure 3B:
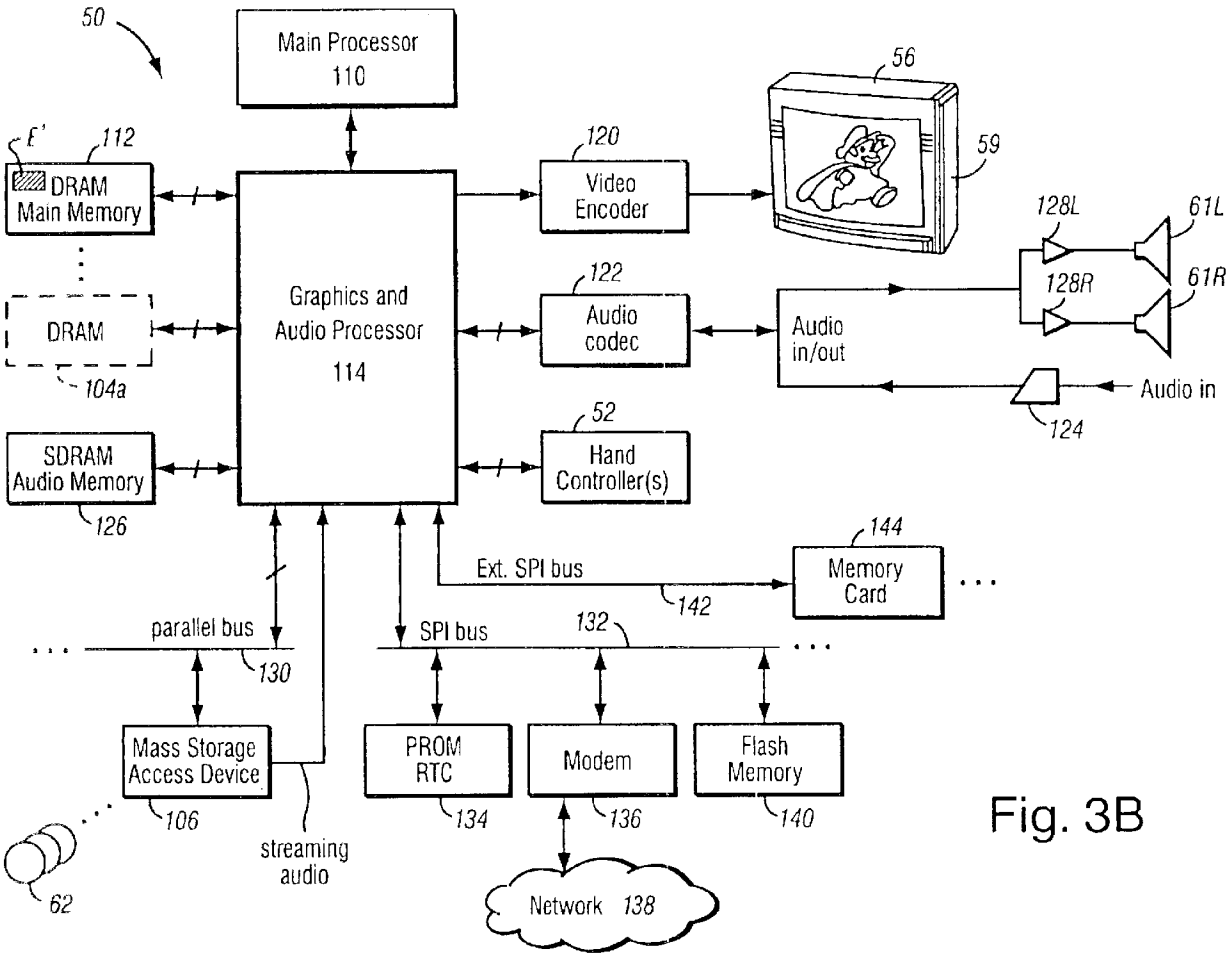

As further shown in FIG. 3B, example system 50 includes a video encoder 120 that receives image signals from graphics and audio processor 114 and converts the image signals into analog and/or digital video signals suitable for display on a standard display device such as a computer monitor or home color television set 56. System 50 also includes an audio codec (compressor/decompressor) 122 that compresses and decompresses digitized audio signals and may also convert between digital and analog audio signaling formats as needed. Audio codec 122 can receive audio inputs via a buffer 124 and provide them to graphics and audio processor 114 for processing (e.g., mixing with other audio signals the processor generates and/or receives via a streaming audio output of mass storage access device 106). Graphics and audio processor 114 in this example can store audio related information in an audio memory 126 that is available for audio tasks. Graphics and audio processor 114 provides the resulting audio output signals to audio codec 122 for decompression and conversion to analog signals (e.g., via buffer amplifiers 128L, 128R) so they can be reproduced by loudspeakers 61L, 61R.

Graphics and audio processor 114 has the ability to communicate with various additional devices that may be present within system 50. For example, a parallel digital bus 130 may be used to communicate with mass storage access device 106 and/or other components. A serial peripheral bus 132 may communicate with a variety of peripheral or other devices including, for example:

a programmable read-only memory and/or real time clock 134, a modem 136 or other networking interface (which may in turn connect system 50 to a telecommunications network 138 such as the Internet or other digital network from/to which program instructions and/or data can be downloaded or uploaded), and flash memory 140.

A further external serial bus 142 may be used to communicate with additional expansion memory 144 (e.g., a memory card) or other devices. Connectors may be used to connect various devices to busses 130, 132, 142.

Figure 3C:
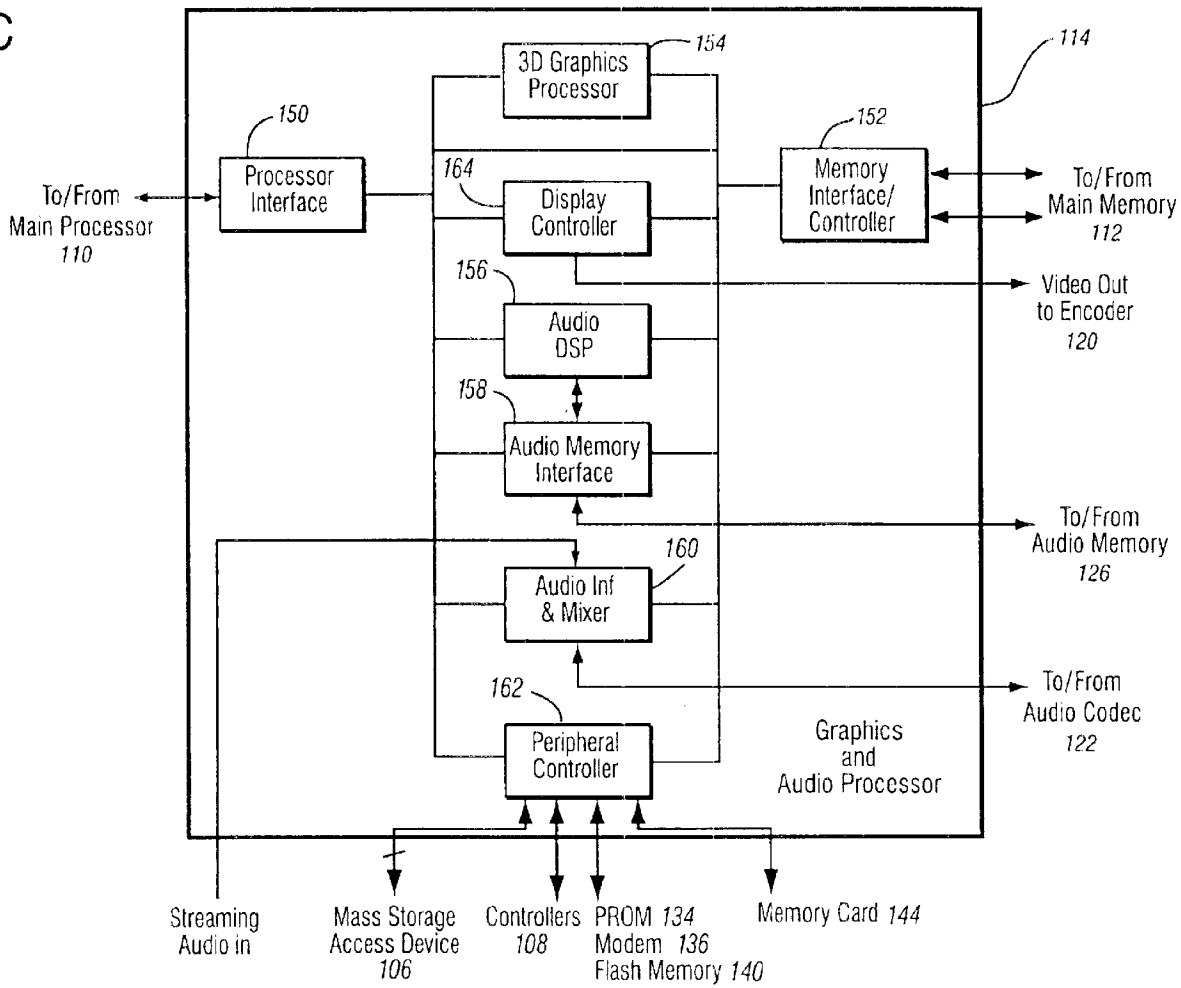

FIG. 3C is a block diagram of an example graphics and audio processor 114. Graphics and audio processor 114 in one example may be a single-chip ASIC (application specific integrated circuit). In this example, graphics and audio processor 114 includes:

a processor interface 150, a memory interface/controller 152, a 3D graphics processor 154, an audio digital signal processor (DSP) 156, an audio memory interface 158, an audio interface and mixer 160, a peripheral controller 162, and a display controller 164.

3D graphics processor 154 performs graphics processing tasks. Audio digital signal processor 156 performs audio processing tasks including sound generation in support of music composition engine E. Display controller 164 accesses image information from main memory 112 and provides it to video encoder 120 for display on display device 56. Audio interface and mixer 160 interfaces with audio codec 122, and can also mix audio from different sources (e.g., streaming audio from mass storage access device 106, the output of audio DSP 156, and external audio input received via audio codec 122). Processor interface 150 provides a data and control interface between main processor 110 and graphics and audio processor 114.

Memory interface 152 provides a data and control interface between graphics and audio processor 114 and memory 112. In this example, main processor 110 accesses main memory 112 via processor interface 150 and memory interface 152 that are part of graphics and audio processor 114. Peripheral controller 162 provides a data and control interface between graphics and audio processor 114 and the various peripherals mentioned above. Audio memory interface 158 provides an interface with audio memory 126. More details concerning the basic audio generation functions of system 50 may be found in copending application Ser. No. 09/722,667 filed Nov. 28, 2000, which application is incorporated by reference herein.

Example Music Composition Engine E

Figure 4:
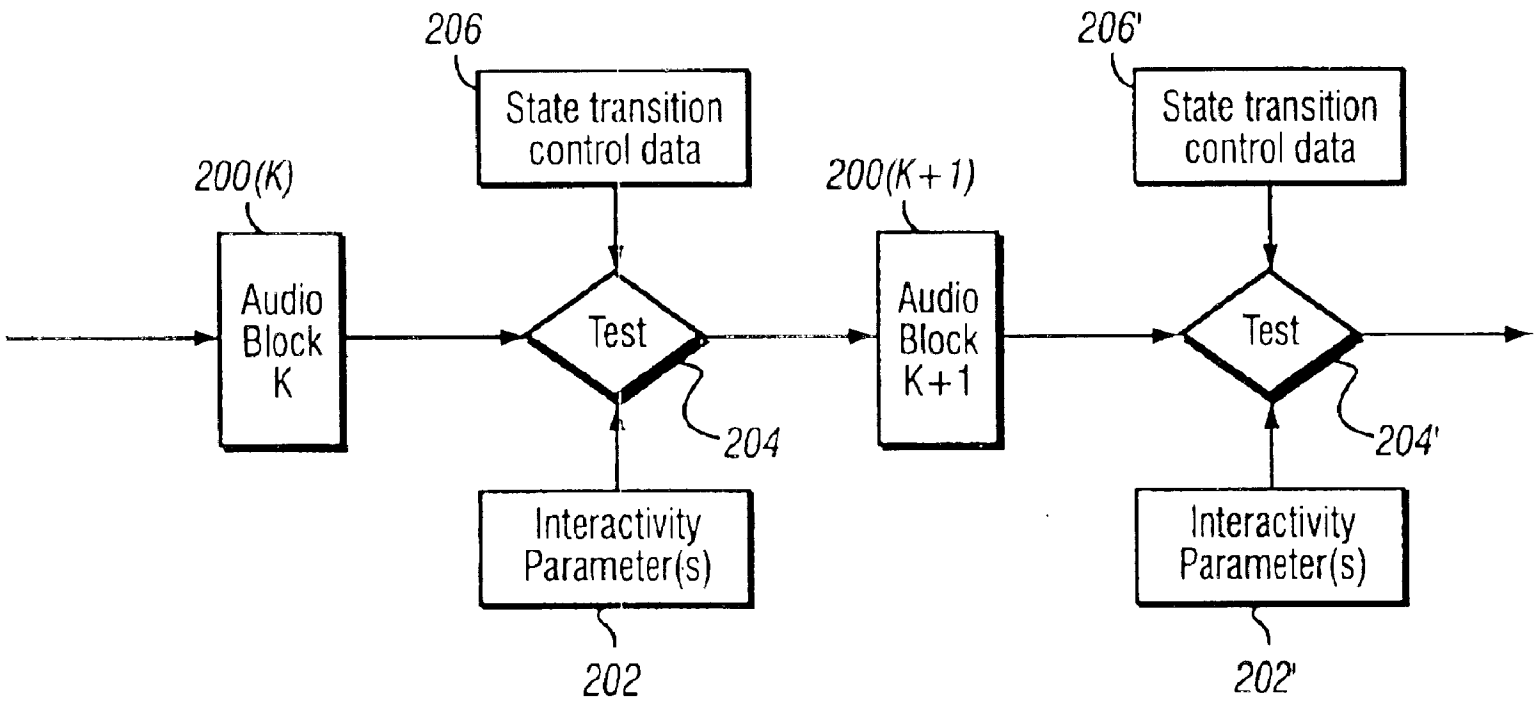
FIG. 4 shows an example process flow controlling transition between musical states.

FIG. 4 shows and example music composition engine E in the form of an audio state machine and associated transition process. In the FIG. 4 example, a plurality of audio blocks 200 define a basic musical composition for presentation. Each of audio blocks 200 may, for example, comprise a MIDI or other type of formatted audio file defining a portion of a musical composition. In this particular example, audio blocks 200 are each of the "looping" type—meaning that they are designed to be played continually once started. In the example embodiment, each of audio blocks 200 is composed and defined by a human musical composer, who specifies the individual notes, pitches and other sounds to be played as well as the tempo, rhythm, voices, and other sound characteristics as is well known. In one example embodiment, the audio blocks 200 may in some cases have common features (e.g., written using the same melody and basic rhythm, etc.) and they also have some differences (e.g., the presence of a lead guitar voice in one that is absent in another, a faster tempo in one than in another, a key change, etc.). In other examples, the audio blocks 200 can be completely different from one another.

In the example embodiment, each audio block defines a corresponding musical state. When the system plays audio block 200(K), it can be said to be in the state of playing that particular audio block. The system of the preferred embodiment remains in a particular musical state and continues to play or "loop" the corresponding audio block until some event occurs to cause transition to another musical state and corresponding audio block.

The transition from the musical state associated with audio block 200(K) to a further musical state associated with audio block 200(K+1) is made based on an interactivity (e.g., game related) parameter 202 in the example embodiment. Such parameter 202 may in many instances also be used to control, gauge or otherwise correspond to a corresponding graphics presentation (if there is one). Examples of such an interactivity parameter 202 include:

- an "adrenaline value" indicating a level of excitement based on user interaction or other factors;
- a weather condition indicator specifying prevailing weather conditions (e.g., rain, snow, sun, heat, wind, fog, etc.);
- a time parameter indicating the virtual or actual time of day, calendar day or month of year (e.g., morning, afternoon, evening, nighttime, season, time in history, etc.);
- a success value (e.g., a value indicating how successful the game player has been in accomplishing an objective such as circling buoys in a boat racing game, passing opponents or avoiding obstacles in a driving game, destroying enemy installations in a battle game, collecting reward tokens in an adventure game, etc.);
- any other parameter associated with the control, interactivity with, or other state or operation of a game or other multimedia application.

In the example embodiment, the interactivity parameter 202 is used to determine (e.g., based on a play cursor 20, a new song flag 22, and predetermined entry and exit points) that a transition from the musical state associated with audio block 200(K) to the musical state associated with audio block 200(K+1) is desired. In one example embodiment, a test 204 (e.g., testing the state of the "new song" flag 20) is performed to determine when or whether the game related parameter 202 has taken on a value such that a transition from the state associated with audio block 200(K) to the state associated with audio block 200(K+1) is called for. If the test 204 determines that a transition is called for, then the transition occurs based on the characteristics of state transition control data 206 specifying, for example, an exit point from the state associated with audio block 200(K) and a corresponding entrance point into the musical state associated with audio block 200(K+1). In the example embodiment, such transitions are scheduled to occur only at predetermined points within the audio blocks 200 to provide smooth transitions and avoid abrupt ones. Other embodiments could provide transitions at any predetermined, arbitrary or randomly selected point.

In at least some embodiments, the interactivity parameter 202 may comprise or include a parameter based upon user interactivity in real time. In such embodiments, the arrangement shown in FIG. 4 accomplishes the result of dynamically composing an overall composition in real time based on user interactivity by transitioning between musical states and corresponding basic compositional building blocks 200 based upon such parameter(s) 202. In other embodiments, the parameter(s) may include or comprise a parameter not directly related to user interactivity (e.g., a setting determined by the game itself such as through pseudo-random number generation).

As shown in FIG. 4, a further transition from the state associated with audio block 200(K+1) to yet another state associated with audio block 200 may be performed based on a further test 204' of the same or different parameter(s) 202' and the same or different state transition data 206'. In one example embodiment, the transition from the musical state associated with audio block 200(K+1) may be to a further state associated with audio block 200(K+2) (not shown). In another embodiment, the transition from the state associated with audio block 200(K+1) may be back to the initial state associated with audio block 200(K).

Example State Transition Control Table

Figure 5:
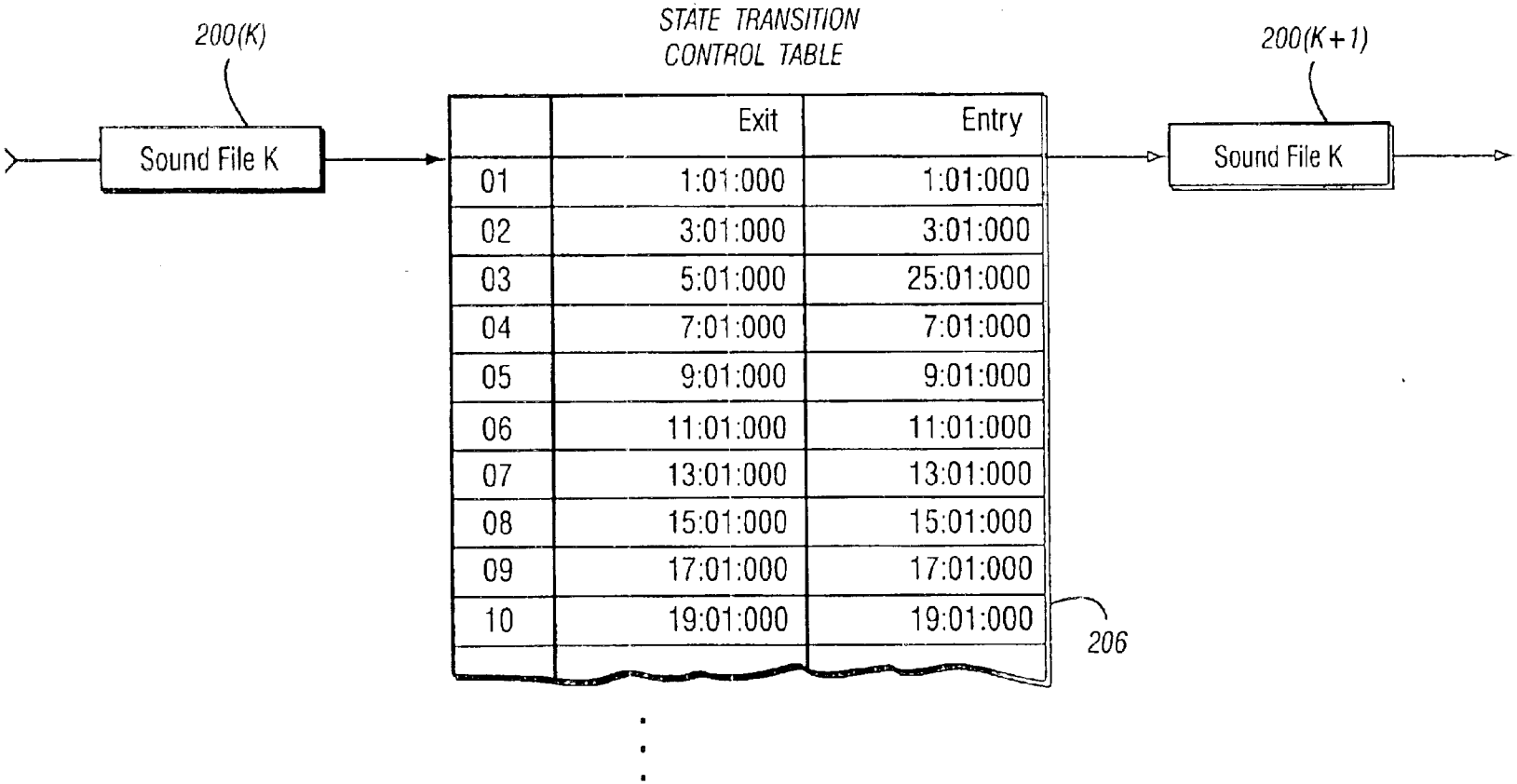
FIG. 5 shows an example state transition control table.

FIG. 5 shows an example implementation of a state transition control data 206 in the form of a state transition table defining a number of exit and corresponding entry points. The FIG. 5 example transition table 206 includes, for example, a first ("01") transition defining a predetermined exit point ("1:01:000") within a first sound file audio block 200(K) corresponding to a first state and a corresponding entry point ("1:01:000") within a corresponding further sound file audio block 200(K+1) corresponding to a further state. The exit and entry points within the example FIG. 5 state transition control table 206 may be in terms of musical measures, timing, ticks, seconds, or any other convenient indexing method. Table 206 thus provides one or more (any number of) predetermined transitional points for smoothly transitioning between audio block 200(K) and audio block 200(K+1).

In some embodiments (e.g., where the audio block 200(K) or 200(K+1) comprises random-sounding noise or other similar sound effect), it may not be necessary or desirable to define any predetermined transitional point(s) since any point(s) will do. On the other hand, in the situation where audio blocks 200(K) and 200(K+1) store and encode structured musical compositions of the more traditional type, it may generally be desirable to specify beforehand the point (s) within each audio block at which a transition is to occur in order to provide predictable transitions between the audio blocks.

In the particular example shown in FIG. 5, sound file audio blocks 200(K), 200(K+1) may comprise essentially the same musical composition with one of the audio blocks having a variation (e.g., an additional voice such as a lead guitar, an additional rhythm element, an additional harmonic dimension, etc.; a faster or slower tempo; a key change; or the like). In this particular example, there are many exit and entry points which correspond quite closely to one another (e.g., exit point "04" at measure "7:01:000" of audio block 200(K) transitions into an entrance point at measure "7:01:000" of audio block 200(K+1), etc.). In other examples, entry and exit points can be quite divergent from one another. In still other examples, two musical states may have associated therewith the same sound file but with different controls (e.g., activation or deactivation of a selected voice or voices, increase or decrease of playback tempo, etc.).

Example Bridging Transitions

Figure 6:
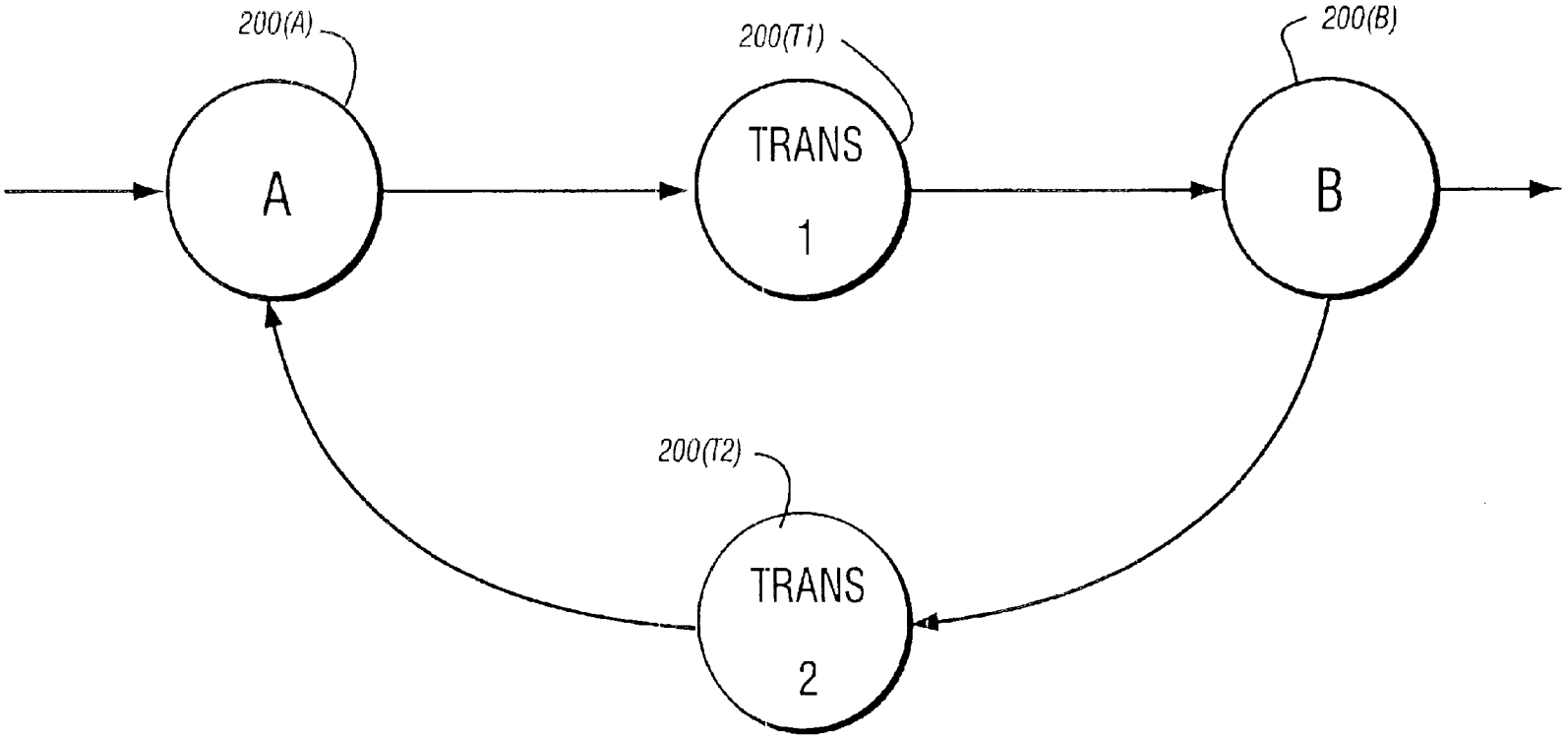
FIG. 6 shows example musical state transitions.

FIG. 6 shows an example alternative embodiment providing a bridging or segueing transition between sound file audio block 200(A) and sound file audio block 200(B). In the FIG. 6 example, an additional, transitional state and associated sound file audio block 200(T1) supplies a transitional music and/or sound passage for an aurally more gradual and/or pleasing transition from sound file audio block 200(A) to sound file audio block 200(B). As an example, the transitional sound file audio block 200(T1) could be a bridging or other segueing audio passage providing a musical and/or sound transition or bridge between sound file audio block 200(A) and sound file audio block 200(B). The use of a transitional audio block 200(T1) may provide a more gradual or pleasing transition or segue—especially in instances where sound file audio blocks 200(A), 200(B) are fairly different in thematic, harmonic, rhythmic, melodic, instrumentation and/or other characteristics so that transitioning between them may be abrupt. Transitional audio block 200(A) could provide for example, a key or rhythm change or transitional material between distinctly different compositional segments.

As also shown in FIG. 6, it is possible to provide a further transitional sound block 200(T2) to handle transitions from the state associated with audio block 200(B) to the state associated with audio block 200(A). The audio transitions from the state of block 200(A) to the state of block 200(B) can be different from the transition going from the state of block 200(B) back to the state of block 200(A).

Example State Clusters

Figure 7:
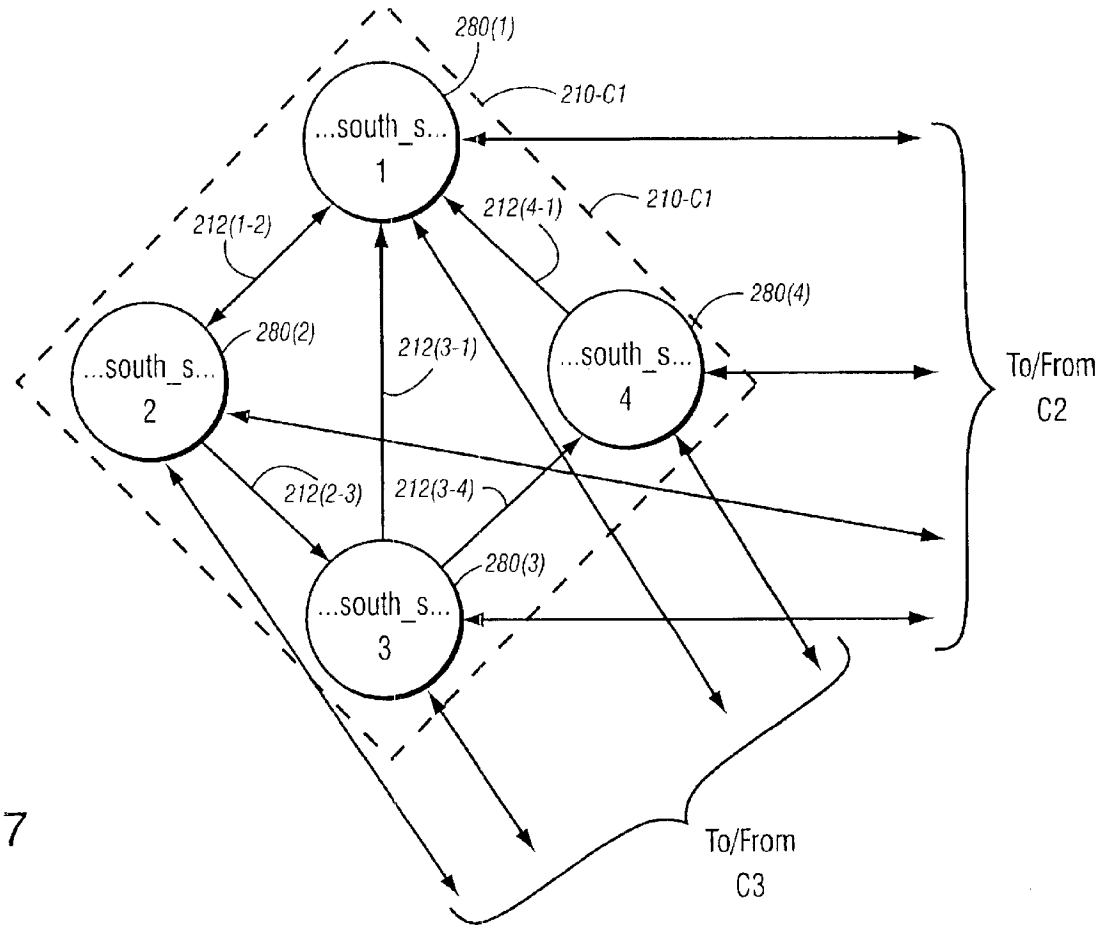
FIG. 7 shows an example musical state machine cluster comprising four musical states with transitions within the state machine cluster and additional transitions between that cluster and other clusters.

FIG. 7 illustrates a set or "cluster" 210(C1) of states 200 associated with a plurality (in this case four) of component musical composition audio blocks 200 with a network of transitional connections 212 therebetween. In the example shown, the transitional connections (indicated by lines with single or double arrows) are used to define transitions from one musical state 280 to another. In the example shown, for example, connection 212(1-2) defines a transition from state 280(1) to state 280(2), and a further connection 212(2-5) defines a transition from state 280(2) to state 280(3).

In more detail, the following transitions are defined by the various musical states 280 by various connections 212 shown in FIG. 7:

- transition from state 280(1) to state 280(2) via connection 212(1-2);
- transition from state 280(2) to state 280(3) via connection 212(2-3);
- transition from state 280(3) to state 280(4) via connection 212(3-4);
- transition from state 280(4) to state 280(1) via connection 212(4-1);
- transition from state 280(3) to state 280(1) via connection 212(3-1); and
- transition from state 280(2) to state 280(1) via connection 212(1-2) (note that this connection is bidirectional in this example).

The example sequential state machine shown in FIG. 7 can be used to provide a sequence of musical material and/or other sounds that increase in excitement and energy as a game player performs well in meeting game objectives, and decreases in excitement and energy as the game player does not meet such objectives. As one specific, non-limiting example, consider a jet ski game in which the game player must pilot a jet ski around a series of buoys and over a series of jumps on a track laid out in a body of water. When the player first turns on the jet ski and begins to move, the game application may start by playing a relatively low excitement musical material (e.g., corresponding to state 280(1)). As the player succeeds in rounding a certain number of buoys and/or increases the speed of his or her jet ski, the game can cause a transition to a higher excitement musical material corresponding to state 280(2) (for example, this higher excitement state may play music with a somewhat more driving rhythmic pattern, a slightly increased tempo, slightly different instrumentation, etc.). As the game player is even more successful and/or successfully navigates more of the water track, the game can transition to an even higher energy/excitement musical material associated with state 280(3) (for example, this material could include a wailing lead guitar to even further crank up the excitement of the game play experience). If the game player wins the game, then victory music material (e.g., associated with state 280(4) can be played during a victory lap. If, at any point during the game, the game player loses control of the jet ski and crashes it or slides into the water, the game may respond by transitioning back to a lowest-intensity music material associated with state 280(1) (see diagram in lower right-hand corner).

For different game play examples, any number of states 280 can be provided with any number of transitions to provide any desired effect based on level of excitement, level of success, level of mystery or suspense, speed, degree of interaction, game play complexity, or any other desired parameter relating to game play or other multimedia presentation.

FIG. 7 shows additional transitions between the states 280 within cluster 210(C1) and other clusters not shown in FIG. 6 but shown in FIG. 7. FIG. 7 illustrates a multi-cluster musical presentation state machine having three clusters (210(C1), 210(C2), 210(C3)) with transitions between various different states of various different clusters. In a simpler embodiment, all transitions to a particular cluster would activate the cluster's initial or lowest energy state first. However, in the exemplary embodiment, clusters 210(C1), 210(C2), 210(C3) represent musical material for different weather conditions (e.g., cluster 210(C1) may represent sunny weather, cluster 210(C2) may represent foggy weather, and cluster 210(C3) may represent stormy weather). Thus, in this particular example, each different weather system cluster 210 has a corresponding low energy, medium energy, high energy and victory lap musical state. Furthermore, in this particular example, weather conditions change essentially independently of the game player's performance just as in real life, weather conditions are rarely synchronized with how well or poorly one is accomplishing a particular desired result). Thus, in the example shown in FIG. 8, some transitions between musical state can occur based on game play parameters that are independent (or largely independent) of particular interactions with the human game player, while other state transitions are directly dependent on the game player's interaction with the game. Such a combination of state transition conditions provides a varied and rich dynamic musical accompaniment to an interesting and exciting graphical game play experience, thus providing a very satisfying and entertaining audio visual multimedia interactive entertainment experience for the game player.

Example Engine Control Operations

Figure 9:
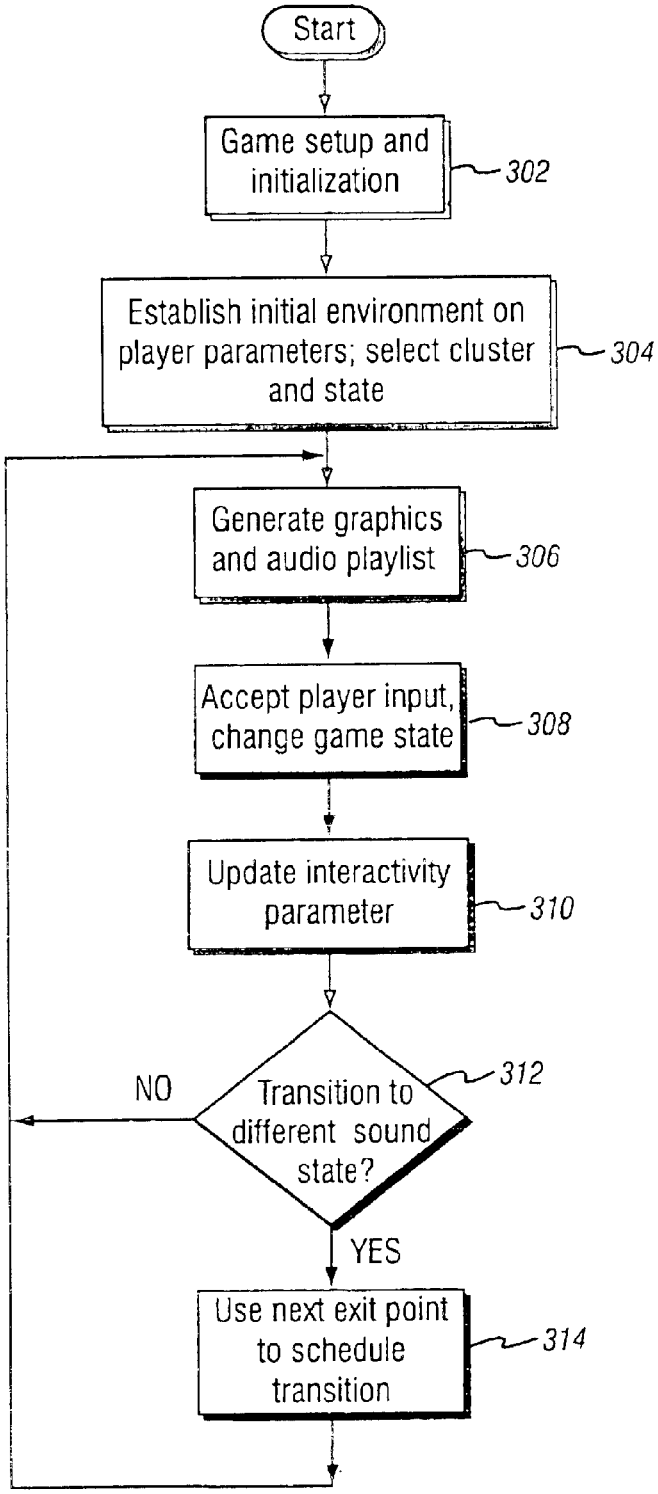
FIG. 9 is a flowchart of example steps performed by an embodiment of the invention.

FIG. 9 is a flowchart of example steps performed by an example video game or other multimedia application embodying the preferred first activates the system and starts appropriate game or other presentation embodiment of the invention. In this particular example, when the game player software running, the system performs a game setup and initialization operation (block 302) and then establishes additional environmental and player parameters (block 304). In the example embodiment, such environmental and player parameters may include, for example, a default initial game play parameter state (e.g., lower level of excitement) and an initial weather or other virtual environmental condition (which may, for example, vary from startup to startup depending upon a pseudo-random event) (block 304). The application then begins to generate 3D graphics and sound by creating a graphics play list and an audio play list in a conventional manner (block 306). This operation results in animated 3D graphics being displayed on a television set or other display, and music and sound being played back through stereo or other loudspeakers.

Once running, the system continually accepts player inputs via a joystick, mouse, keyboard or other user input device (block 308); and changes the game state accordingly (e.g., by moving a character through a 3D world, causing the character to jump, run, walk, swim, etc.). As a result of such interactions, the system may update an interactivity parameter(s) 202 (block 310) based on the user interactions in real time or other factors. The system may then test the interactivity parameter 202 to determine whether or not to transition to a different sound-producing state (block 312). If the result of testing step 312 is to cause a transition, the system may access state transition control data (see above) to schedule when the next transition is to occur (block 314). Control may then return to block 306 to continue generating graphics and sound.

Figure 8:
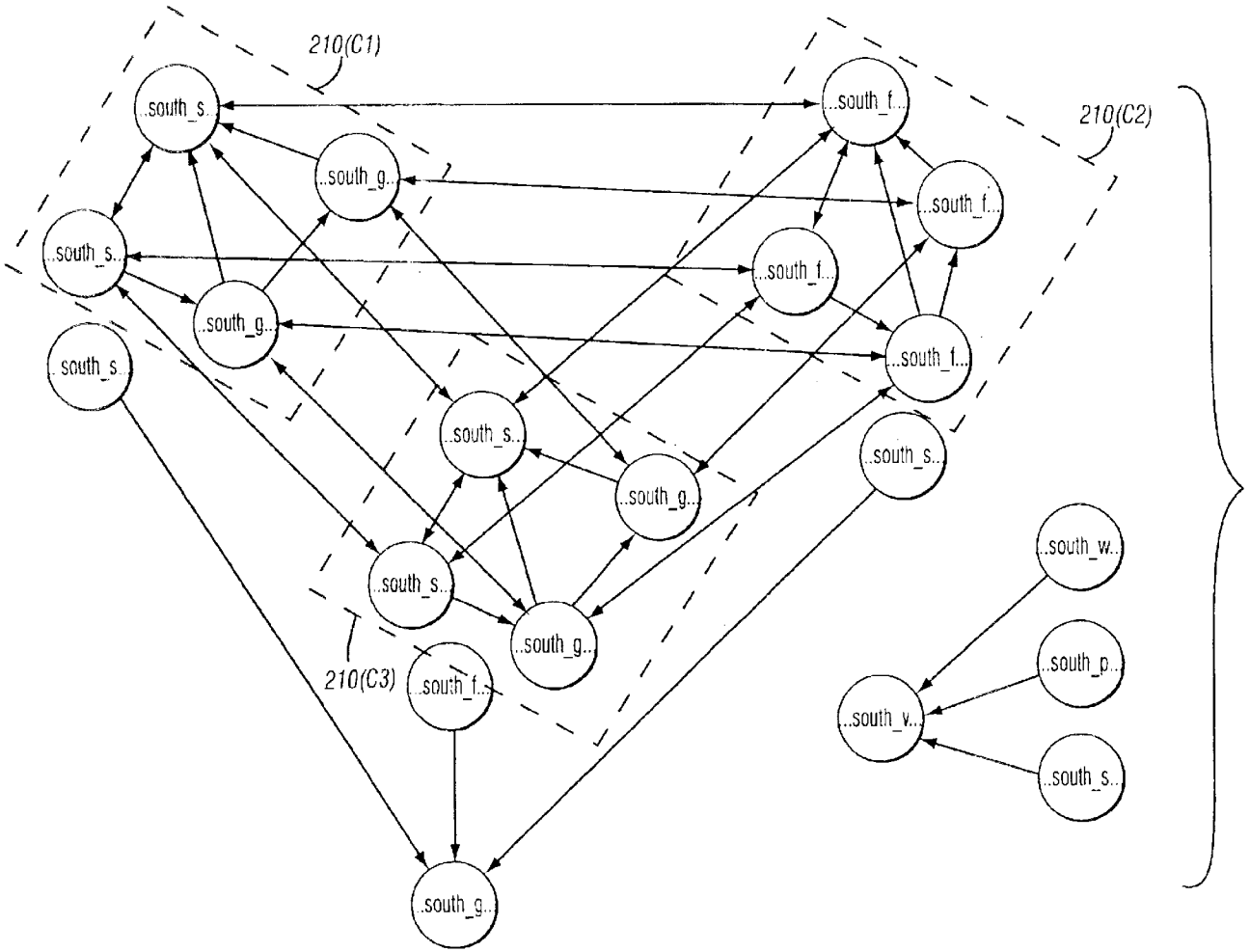
FIG. 8 shows an example three-cluster sound generation state machine diagram.
Figure 10:
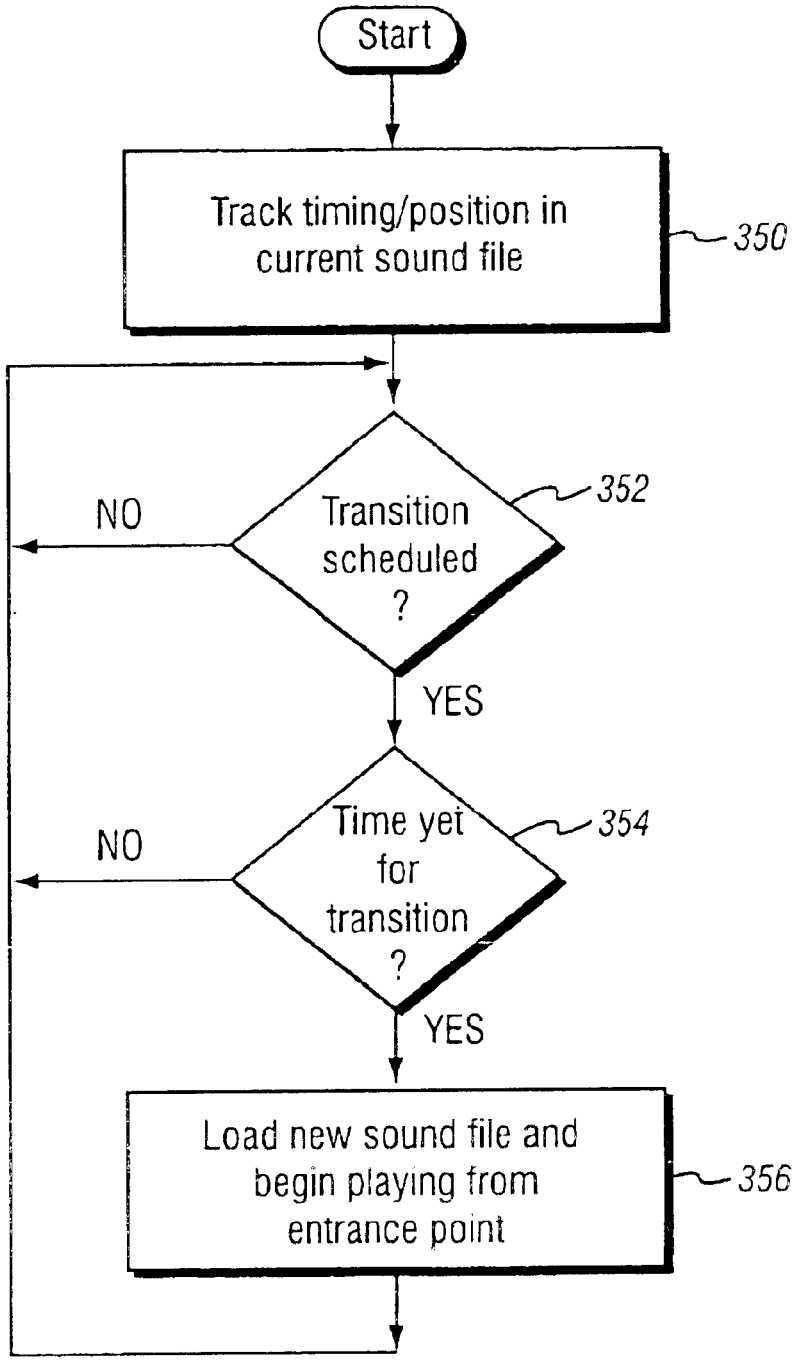
FIG. 10 is a flowchart of an example transition scheduler.

FIG. 10 is a flowchart of an example routine used to perform transitions that have been scheduled by the transition scheduling block 314 of FIG. 8. In the example shown, the system tracks the timing/position in the currently-playing sound file based on a play cursor 20 (block 350) (this can be done using conventional MIDI or other playback counter mechanisms). The system then determines whether a transition has been scheduled based on a "new song" flag 22 (decision block 352)—and if it has, whether it is time yet to make the transitions (decision block 354). If it is time to make a scheduled transition ("yes" exit to decision block 354), the system loads the appropriate new sound file corresponding to the state just transitioned to and begins playing it from the entry point specified in the transition data block (block 356).

Example Development Tool

Figure 11:
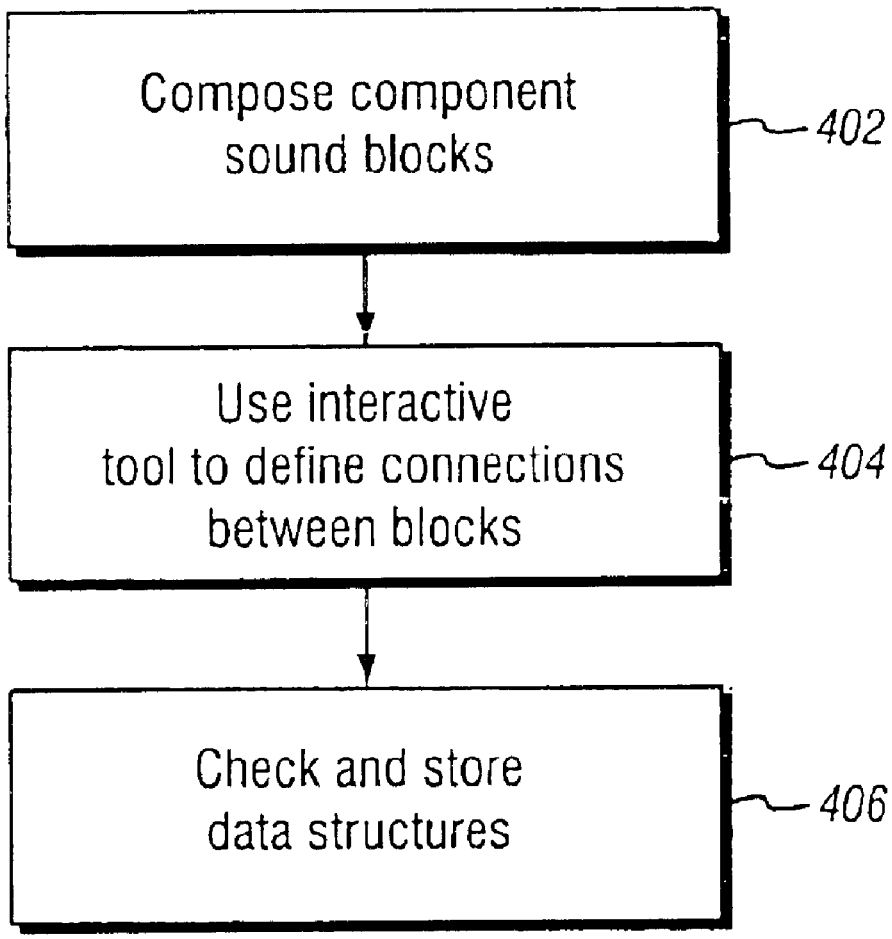
FIG. 11 is a flowchart of overall example steps used to generate an interactive musical composition system.

FIG. 11 shows an example process and associated development procedure one may follow to develop a video game or other application embodying the present invention. In this example, a human composer first composes underlying musical or sound components by conventional authoring techniques to provide a plurality of musical components to accompany the desired video game animation or other multimedia presentation graphics (block 402). This human composer may store the resulting audio files in a standard format such as MIDI on the hard disk of a personal computer. Next, an interactive music editor may be used to define the audio presentation sequential state machine that is to be used to present these various compositional fragments as part of an overall interactive real time composition (block 404).

Figure 12:
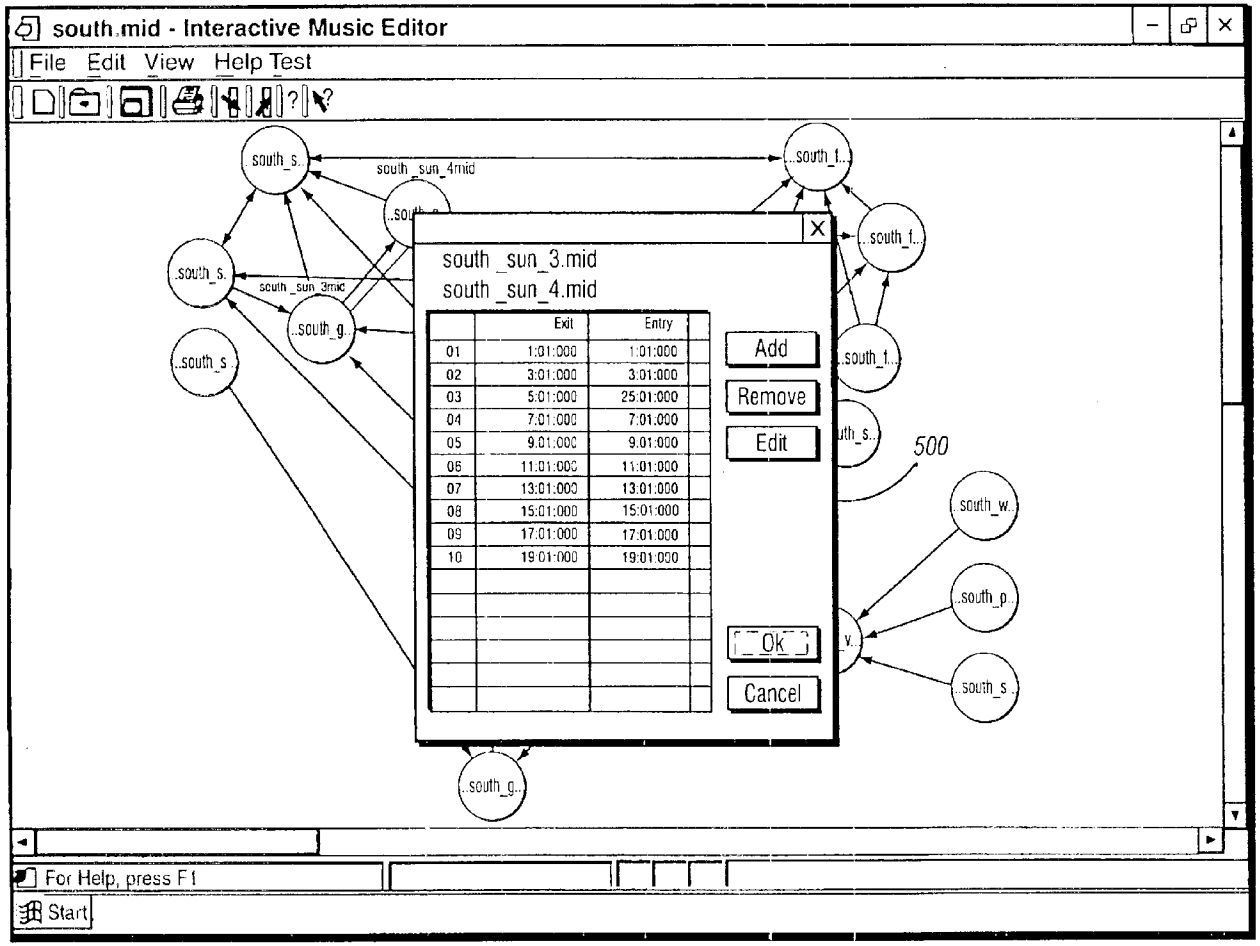
FIG. 12 is an example screen display of an interactive music editor graphical user interface allowing definition/editing of connections between musical states.

FIG. 12 shows an example of screen display that represents each defined musical state 280 with an associated circle, node or "bubble" and the transitions between states as arrowed lines interconnecting these circles or bubbles. The connection lines can be either uni-directional or bi-directional to define the manner in which the states may be transitioned from one another. This example screen display allows the developer to visualize the different pre-composed musical or sound segments and transitions therebetween. A graphical user interface input/display window 500 may allow a human editor to specify, in any desired units, exit and entry points for each one of the corresponding transition connections by adding additional entry/exit point connection pairs, removing existing pairs or editing existing pairs. Once the developer has defined the sequential state machine, the interactive editor may save all of the audio files in compressed format and save the corresponding state transition control data for real time manipulation and presentation (block 406).

While the invention has been described in connection with what is presently considered to be the most practical and preferred embodiment, it is to be understood that the invention is not to be limited to the disclosed embodiment. For example, while the preferred embodiment has been described to and in connection with a video game or other multimedia application with associated graphics such as 3D computer-generated graphics for example, other variations are possible. As one example, a new type of musical instrument with user-manipulable controls and no corresponding graphical display could be used to dynamically generate musical compositions in real time using the invention as described herein. Also, while the invention is particularly useful in generating, interactive musical compositions, it is not limited to songs and can be used to generate any sound or sound track including sound effects, noises, etc. The invention is intended to cover various modifications and equivalent arrangements included within the scope of the appended claims.

We claim:

1. A computer-assisted sound generation method that uses a computer system to generate sounds with transitional variations the computer system dynamically introduces based on user interaction with the computer system, said method comprising:

defining plural predefined states of an associated state machine providing variable sequences of said states and at least some predefined conditions for transitioning between said states, at least some of said states of the state machine having an associated pre-defined music composition component and at least one predetermined exit point associated therewith;

defining an interactivity parameter responsive at least in part to user interaction with the computer system;

transitioning between said pre-defined states at said predetermined exit points based at least in part on the interactivity parameter; and producing sound in response to a current said states and said transitions between said states such that said interactivity parameter at least in part dynamically selects, based on said predefined conditions, transitions between said musical composition components and associated produced sounds.

2. The method of claim 1 wherein said interactivity parameter is responsive to a user input device.

3. The method of claim 1 wherein each of said pre-defined music composition components comprises a MIDI file with loop back.

4. The method of claim 1 wherein said transitioning is performed in response to state transition control data, said state transition control data predefining said conditions for transitioning between said states.

5. The method of claim 4 wherein said state transition control data comprises at least one exit point and at least one entrance point per state.

6. The method of claim 1 wherein said producing step is performed using, at least in part, a 3D graphics and audio processor.

7. The method of claim 1 further comprising generating computer graphics associated with said states based at least in part on said interactivity parameter.

8. The method of claim 1 wherein at least some of said music composition components comprise humanly-authored precomposed and performed musical components.

9. A computer system for dynamically generating sounds comprising:

a storage device that stores a plurality of musical compositions precomposed by a human being;

said storage device storing additional data assigning each of said plurality of musical compositions to a state of a state machine providing sequences of states and at least some predefined conditions for transitioning between said states and defining connections between said states;

at least one user-manipulable input device; and a music engine responsive to said user-manipulable input device that transitions between different states of said state machine in response to user input, thereby dynamically generating a musical or other audio presentation based on user input by dynamically selecting between different precomposed musical compositions such that said user input at least in part dynamically selects transitions between said musical compositions.

10. The system of claim 8 wherein at least one of said states is selected also based on a variable other than user interactivity.

11. The system of claim 8 wherein each of said plurality of musical compositions is stored in a looping audio file.

12. The system of claim 8 wherein at least some of said plurality of musical compositions and associated states are selected based at least in part on virtual weather conditions.

13. The method of claim 8 wherein at least some of said states are selected based at least in part on an adrenaline factor indicating overall excitement level.

14. The system of claim 8 wherein at least some of said states are selected based at least in part on success in accomplishing game play objectives.

15. The system of claim 8 wherein at least some of said states are selected based at least in part on failure to accomplish game play objectives.

16. A method of dynamically producing sound effects to accompany video game play, said video game having an environment parameter, said method comprising:

defining at least one cluster of musical states and associated state transition connections therebetween, said cluster defining sequences of sound states and at least some predefined conditions for transitioning between said sound states based at least in part on interactive user input, at least some of said states having precomposed sounds associated therewith;

accepting user input;

transitioning between said states within said cluster based at least in part on said accepted user input; and transitioning between said states within said cluster and additional states outside of said cluster based at least in part on a video game environment parameter.

17. The method of claim 16 wherein said video game environment parameter comprises a virtual weather indicator.

18. A method of generating music via computer of the type that accepts user input, said method comprising;

storing first and second sound files each encoding a respective precomposed musical piece, said sound files defining a state machine providing a sequence of states and at least some predefined conditions for transitioning between said states;

dynamically transitioning, in response to user input and under predefined transitioning conditions, between said first sound file and said second sound file by using a predetermined exit point of said first sound file and a predetermined entrance point of said second sound file; and performing an additional transition between said first sound file and said second sound file via a third, bridging sound file providing a smooth transition between said first sound file and said second sound file.

19. The method of claim 18 wherein at least one of said predetermined exit and entrance points is other than the beginning of the associated sound file, said predefined music composition components each comprising a portion of a musical composition precomposed by a human composer.

20. A method of generating interactive program material for a multimedia presentation comprising:

defining at least one cluster of states and associated state transition connections therebetween, said cluster defining sequences of states and predefined conditions for transitioning between said states based at least in part on interactive user input, said states each having programmable presentation material associated therewith;

accepting user input;

transitioning between said states within said cluster based at least in part on said accepted user input; and transitioning between said states within said cluster and additional states outside of said cluster based at least in part on a variable multimedia presentation environment parameter other than said accepted user input to present a dynamic programmable multimedia presentation to the user that dynamically responds to said accepted user input.

* * * * *